US005921787A

United States Patent [19]

Pope et al.

[11] Patent Number: 5,921,787

[45] Date of Patent: Jul. 13, 1999

[54] BOARD-TO-BOARD INTERCONNECTION

[75] Inventors: Richard A. Pope, Austin, Tex.; Guenter Ploehn, Bad Schwartau, Germany; Thomas M. Cherney, Georgetown, Tex.; Juergen K. Schmidt, Hamburg, Germany; David S. Hardcastle, Liberty Hill, Tex.; Adalberto Gonzalez, Lake Worth, Fla.

[73] Assignee: Minnesota Mining and Manufacturing Company, Saint Paul, Minn.

[21] Appl. No.: 08/682,487

[22] Filed: Jul. 17, 1996

Related U.S. Application Data

[51] Int. Cl.[6] ..... H01R 9/09

[52] U.S. Cl. ..... 439/74; 439/660

[58] Field of Search ..... 439/74, 83, 284, 439/295, 666, 108

[56] References Cited

U.S. PATENT DOCUMENTS

| | | | |
|---|---|---|---|
| 4,418,974 | 12/1983 | MacDougall | 339/75 |
| 4,804,336 | 2/1989 | Miller et al. | 439/218 |
| 5,098,311 | 3/1992 | Roath et al. | 439/74 |
| 5,145,407 | 9/1992 | Obata et al. | 439/567 |
| 5,154,627 | 10/1992 | Lee | 439/326 |
| 5,181,855 | 1/1993 | Mosanera et al. | 439/74 |
| 5,241,451 | 8/1993 | Walburn et al. | 361/785 |
| 5,263,867 | 11/1993 | Doi et al. | 439/62 |
| 5,376,009 | 12/1994 | Olsson et al. | 439/74 |
| 5,380,225 | 1/1995 | Inaoka | 439/660 |
| 5,433,616 | 7/1995 | Walden | 439/62 |
| 5,542,851 | 8/1996 | Chikano | 439/608 |
| 5,618,191 | 4/1997 | Chikano et al. | 439/108 |
| 5,641,290 | 6/1997 | Yagi | 439/74 |
| 5,697,799 | 12/1997 | Consoli et al. | 439/181 |
| 5,733,142 | 3/1998 | Clark | 439/567 |

FOREIGN PATENT DOCUMENTS

| | | | |
|---|---|---|---|
| 647990 A1 | 12/1995 | European Pat. Off. | H01R 23/70 |
| 734098 A2 | 9/1996 | European Pat. Off. | H01R 9/09 |
| DE 37 03020 | 8/1988 | Sweden | H01R 13/187 |
| WO 93/03513 | 2/1993 | WIPO | H01R 9/09 |

*Primary Examiner*—Neil Abrams
*Assistant Examiner*—T C Patel
*Attorney, Agent, or Firm*—Matthew B. McNutt

[57] ABSTRACT

An interconnection providing multiple electrical interconnections at a fine pitch can be formed in a pluggable and unpluggable form having a pitch on the order of 0.8 mm, using four rows of contact elements in each of the plug and socket which are in a continuous row and not staggered along the row with other contact elements, making the interconnection easier to manufacture and utilize.

16 Claims, 7 Drawing Sheets

BOARD-TO-BOARD INTERCONNECTION

BACKGROUND OF THE INVENTION

1. Field of the Invention

This invention relates to an improvement in fine pitch connectors for connecting printed circuit boards (PCB) for board stacking, vertical to vertical, mother to daughter, vertical to right angle and/or straddle, and in one aspect relates to an improved connector comprising a plug and a socket each having four rows of electrical contact elements.

2. Description of the Prior Art

The art is replete with connectors for making multiple interconnections between boards, between boards and discreet wires, and between boards and flexible circuits, all of which have the goal of making the most interconnections per area of board space.

For example, board to board connectors are illustrated in WO 93/03513 published Feb. 18, 1993 and in U.S. Pat. No. 5,380,225 issued Jan. 10, 1995, available from the assignee of this patent (application). The publication illustrates a board to board interconnection of the hermaphroditic design wherein the connector portions have the identical shape and are mated in a single orientation to ensure proper electrical connection. Further, the solder tails of the connector portions are spaced 1 mm and each portion of the connector is formed to have a row of passive contacts (fixed contact surfaces) and a row of active contacts (movable spring contact surface). This relationship, according the publication, reduces the required overall PCB to PCB stack height (the distance between two coupled circuit boards) because only one spring height is required. Further, since each connector has both spring contacts and fixed contacts, the spring force on the movable contacts is the same from its initial mate height until the final mate height. The movable spring contacts are deflected by the same predetermined amount regardless of the PCB to PCB stack height. The latter patent referenced above teaches the use of a connector making four rows of contacts. This connector however discloses the contact elements of a passive nature in the plug 1*a* and the active, flexible contacts in the jack 1. The contact elements are however all spaced and staggered to form the four rows of contacts of equal number in one connector, lengthwise thereof. Other PCB to PCB interconnections are shown in WO 90/16093 where opposed spring contacts were employed which increased the stack height.

U.S. Pat. No. 4,804,336 discloses a D-shaped connector having improved density by using staggered rows of pin contacts in the body to double the density from the normal 50 contacts to 100. As in U.S. Pat. No. 5,380,225, staggering and duplicity alone does not serve to adequately improve the density of the interconnections to be made and still reduce the stack height.

SUMMARY OF THE INVENTION

The present invention provides an interconnection which meets the design criteria of the electronic industry. The interconnection of the present invention comprises a mating socket and plug. The socket comprises a body including a base and three parallel wall members positioned on one side of the base forming a central wall member and opposed identical side wall members and the central wall member has opposite surfaces and the side wall members have surfaces opposed to the opposite surfaces of the central wall member. Electrical contact elements are positioned along the opposite surfaces of the central wall member forming two rows of contact elements and electrical contact elements are positioned along the opposed surfaces of the side wall members forming two additional rows of contact elements. The plug comprises a body having a top wall and at least two depending spaced parallel wall members, with each wall member having opposite surfaces, and the parallel wall members being adapted to be disposed one on each side of the socket central wall member. Electrical contact elements are positioned along the opposite surfaces of the parallel wall members forming four rows of contact elements for electrical contact with the electrical contact elements positioned along the opposite surfaces of the central wall member and with the electrical contact elements positioned along the side wall members.

The interconnection of the present invention comprises a socket and a plug to permit interconnection of a PCB to a PCB, for board stacking, vertical to vertical, mother to daughter, vertical to right angle and/or straddle. The interconnection of the present invention can be coupled to the PCB in any of a number of ways, with two single rows the solder bonds could be at a spacing of 0.4 mm, or in four staggered rows with the bonds at 0.8 mm spacing, or by pin bonds at 0.8 mm spacing between solder bonds. Various connections reduce the foot print of the part and the amount of real estate used on the PCB or other.

One embodiment affords an interconnection of reduced width by having only two rows of spring contacts (active) in each part of the interconnection, narrower solder tails on the contacts outside the connector parts, notches on the part to permit the positioning of the solder tails in the parts for improved board attachment, stability, reliability against cross talk, and assuring impedance.

In one embodiment, the socket and plug form mirror images about a plane forming a longitudinal section of the socket and plug. Further, in a preferred embodiment the active contact elements of the socket and plug are cantilever mounted and each are formed with an arcuate end portion forming the contact portion which interferes with and makes electrical contact with the passive contact elements upon mating the socket with the plug.

BRIEF DESCRIPTION OF THE DRAWINGS

The present invention will be further described with reference to the accompanying drawing wherein.

DESCRIPTION OF THE PREFERRED EMBODIMENT

The present invention provides an improved high density, fine pitch, electrical interconnection for use in board stacking, vertical to vertical, mother to daughter, vertical to right angle and/or straddle. The present invention allows a 0.4 mm spacing between solder bonds connecting the contact elements of the interconnection to a circuit on the PCB if the solder feet form two single lines, or at a spacing of 0.8 mm when alternate solder pads are staggered and placed in four rows as illustrated.

Figure 1:
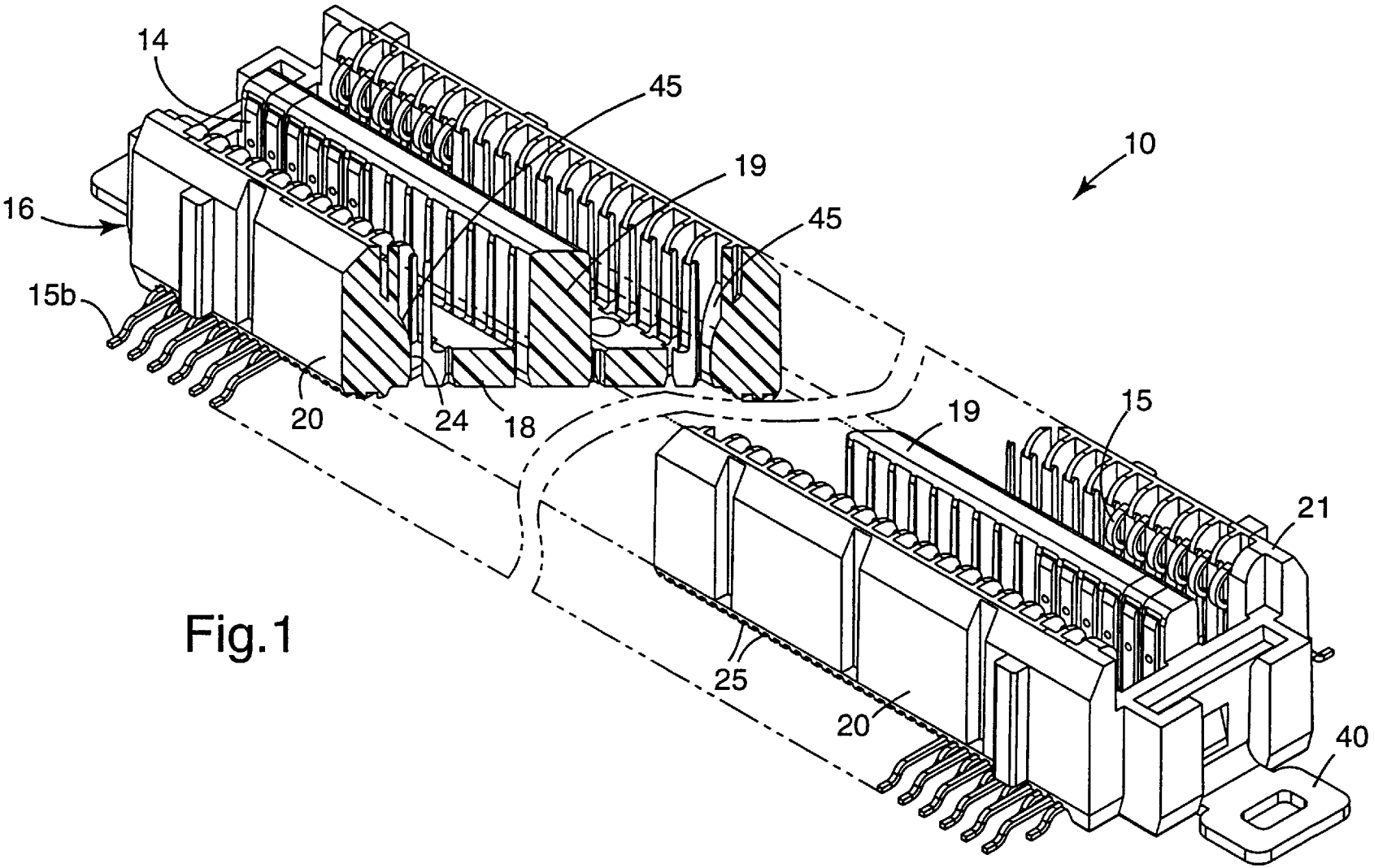
FIG. 1 is a perspective view of the socket of an electrical interconnection according to the present invention.
Figure 2:
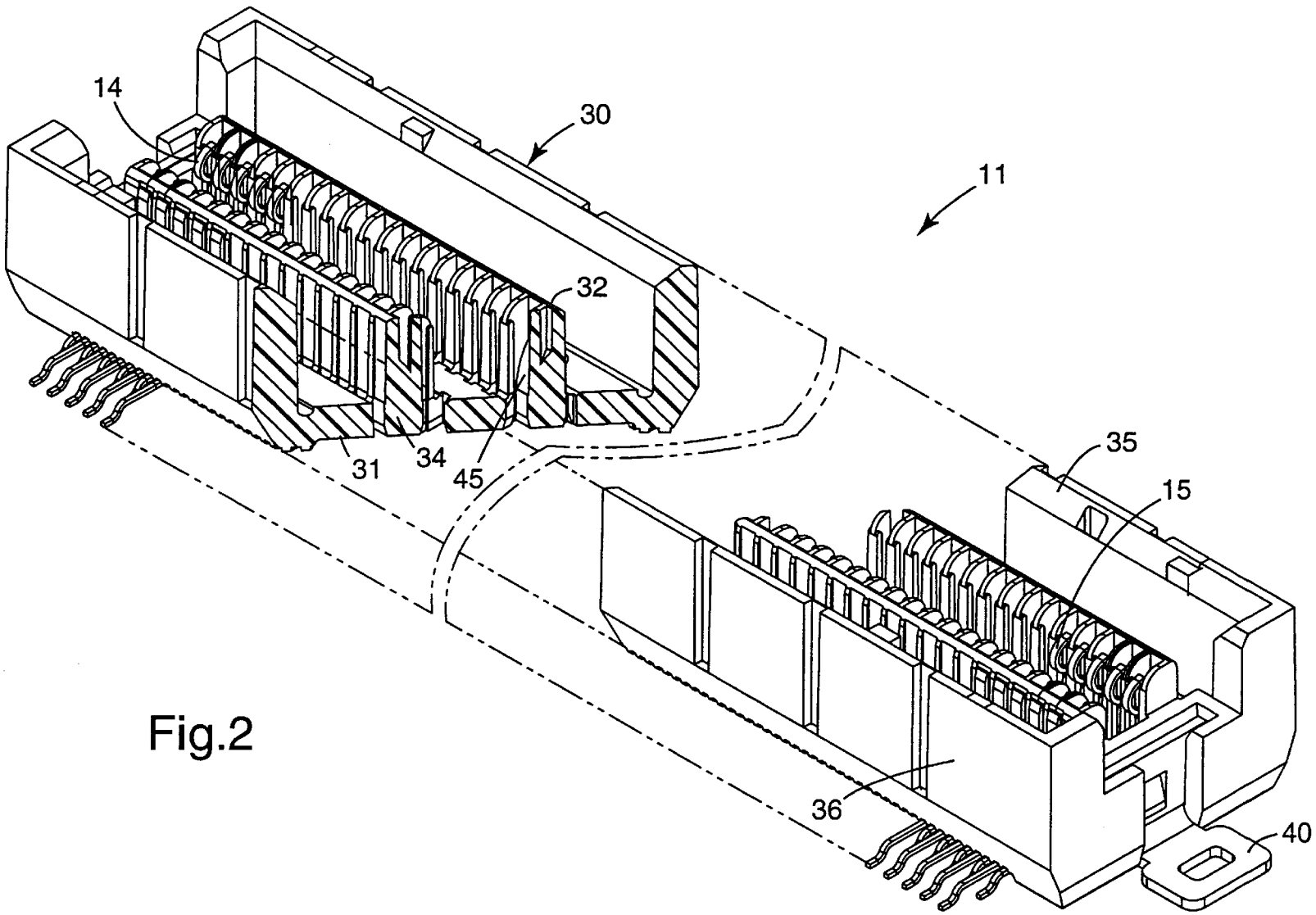
FIG. 2 is a perspective view of the plug of an electrical interconnection according to the present invention.
Figure 3:
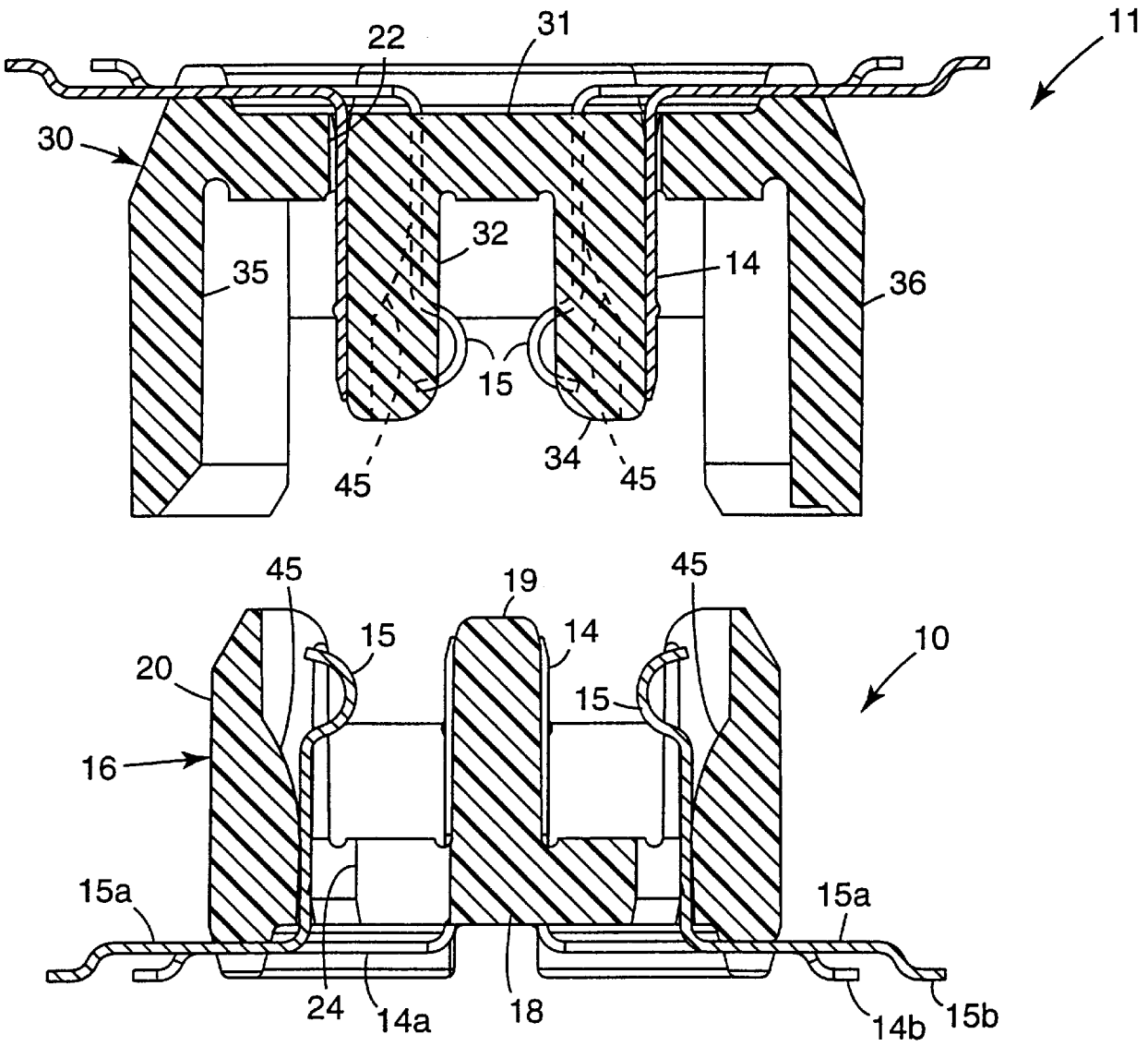
FIG. 3 is a vertical cross sectional view taken through the socket of FIG. 1 and the plug of FIG. 2 with the same disposed in position for interconnection.
Figure 8:
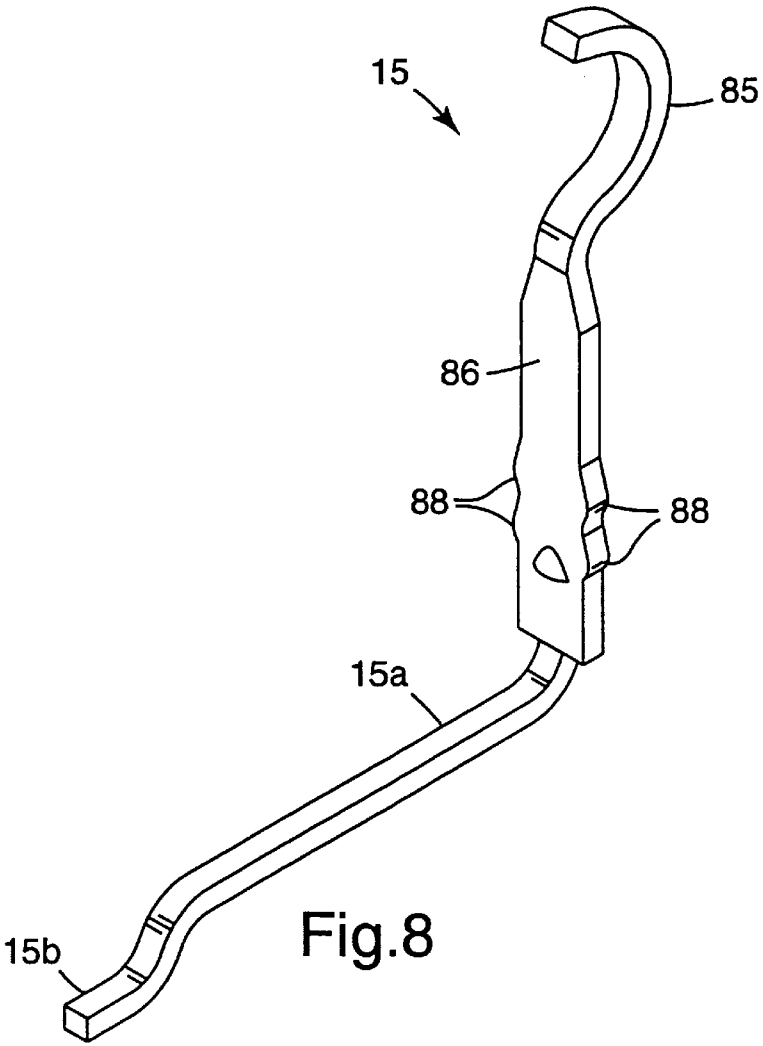
FIG. 8 is a perspective view of an active contact element.
Figure 7:
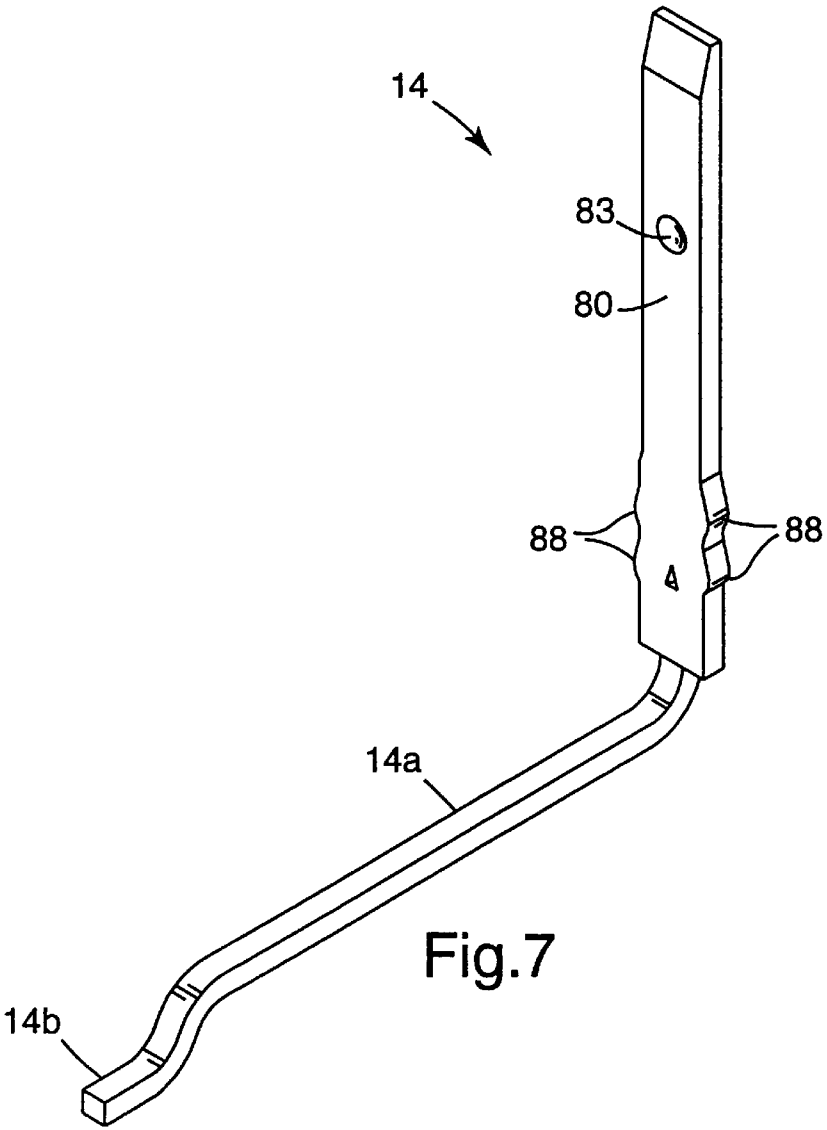
FIG. 7 is a perspective view of a passive contact element.

In the accompanying drawing, FIGS. 1, 2 and 3 illustrate an interconnection according to the present invention comprising a socket 10 and a plug 11, each of which utilize passive contact elements 14 as illustrated in FIG. 7 and active contact elements 15 as illustrated in FIG. 8. The socket 10 has a body 16 comprising a base 18 and three spaced parallel wall members positioned on one side of the base 18. The three parallel wall members form a central wall member 19, having opposite surfaces, and opposed identical side wall members 20 and 21, that are positioned on the base as mirror images of each other in opposed relationship to each other and in opposed relationship to the central wall 19. Two rows of identical active contact elements 15 are supported on the wall members 20 and 21 and two rows of identical passive contact elements 14 are supported on the opposite surfaces of the central wall member 19 of the socket body 16. The rows of active and passive contact elements are positioned in offset relationship with respect to each other. The contact elements 14 and 15 have a mating portion positioned within the socket 10. They may be connected to the PCB or other circuit carrying member any number of ways, but as illustrated the contact elements have and solder tails of a reduced dimension extending through the base 18 to an offset solder foot adjacent the end thereof. The solder tails 14*a* and 15*a*, as illustrated, are positioned through openings 22 and 24 respectively in the base 18 and are bent to form an included angle in relationship to the contact portion of about 85° to direct the solder tails outward of the socket and between stabilizing notches 25 formed in the base 18 on the side opposite the side wall members 20 and 21. It should be noted the solder tails 14*a* of the passive contact elements 14 do not extend outward as far to the foot 14*b* as the solder tails 15*a* on the active contact elements 15. The solder tails 14*a* and 15*a* are of substantially equal length on the passive and the active contact elements to control impedance.

The plug 11 has a body 30 and two rows of passive contact elements 14 and two rows of active contact elements 15. The body 30 has a wall 31 forming a top wall and depending side walls 32 and 34 positioned centrally of the body 30 in spaced parallel position to receive the central wall 19 and the passive contact elements 14 of the socket therebetween. Positioned in outwardly spaced relationship to the walls 32 and 34, are walls 35 and 36 which form outside covering members for the interconnection. The walls 35 and 36 have beveled or tapered edges to form guides to receive the side walls 20 and 21 therebetween. These walls 35 and 36 are enclosures and are not necessary to the operation of the interconnection. On the walls 32 and 34 are positioned two opposed rows of active contact elements 15 and on the opposite sides of the wall members 32 and 34 are passive contact elements 14 positioned for engagement by the active contact elements 15 in the socket 10. The plug 11 is adapted to mate with the socket and the wall members 32 and 34 support two rows of spaced active contact elements 15 affording engagement with the two rows of passive contact elements on the central wall 19 of the socket, and the wall members 32 and 34 of the plug have outside wall surfaces supporting contact elements 14 affording electrical engagement with the active contact elements 15 on socket side wall members 20 and 21. The contact elements on the plug can be joined to a PCB in a number of ways, but as illustrated have solder tail portions extending an equal distance through the openings in the top wall 31 to a stepped solder foot adapted to bond to a circuit. The solder tails are in a plane and held in notches along the sides of the body 30. The solder feet 14*a* and 15*a* form four rows of contact points. The four rows of solder feet of the plug corresponding to the four rows of solder feet on the socket form staggered rows of solder pads adjacent the respective plug and socket. The solder feet from the contact elements 14 supported from the central wall member of the socket 10 are disposed inward and in adjacent offset or stepped relationship to the solder feet 15*b* from the contact elements 15 supported by the side wall members 20 and 21 of the socket 10. The same relationship is true for the plug, but reversed.

The socket 10 and the plug 11 have a corresponding number of contact elements on each side of a mid-plane dividing the socket and plug vertically. The tail portions 14*a* of the contact elements 14 on the central wall form two rows of contact bonds 46 and 48, see FIG. 4, positioned within the two rows 49 and 47 of contact bonds formed by the contact tails 15*a* of the contact elements 15 positioned on opposed sides of the side wall members 20 and 21 of the socket. In the embodiment of FIGS. 1–3, the socket 10 and the plug 11 form mirror images about a plane forming a longitudinal section of the socket and plug. Further, in a preferred embodiment the active contact elements of the socket and plug are supported and each are formed with a arcuate end portion forming the contact portion which interferes with and contacts the passive contact elements upon mating the socket with the plug. This relationship will be discussed below and with reference to FIG. 8.

The ends of the socket 10 and the plug 11 are formed to support an attaching bracket 40. The brackets 40 are affixed to the socket and plug to hold the socket and plug respectively to the PCB to which they are mounted. The strength of the socket 10 is improved by having a greater number of passive contact elements on the central wall member 19 to extend the central wall from end wall to end wall of the socket. Also, it is desired to have the wall members 32 and 34 extend between end wall and end wall of the plug.

Figure 3A:
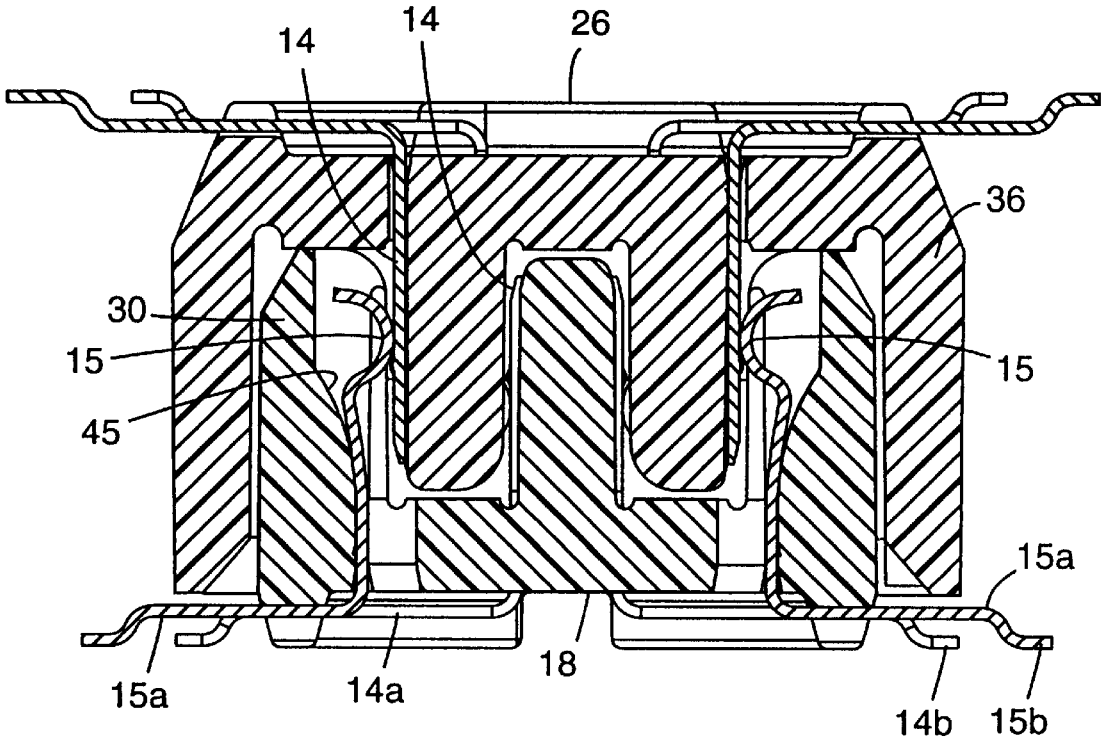
FIG. 3A is a view of the plug and socket of FIG. 3 in an engaged relationship.

As best shown in FIG. 3, the active contacts 15 are positioned adjacent to a wall surface 45 of the side wall members 20 and 21 and the wall members 32 and 34 which is formed with an arcuate configuration of a given radius. This construction provides an extended life for the contact element and an increase in the spring force in the active contact elements 15 as the plug is inserted into the socket. Further, the bending stress on the active contact elements is placed along the length of the contact element body in the socket or plug, as opposed to being isolated at exit point of the contact element from the base 18 or top wall 31. FIG. 3A shows the sockets 10 and plug 11 of FIG. 3 in an engaged relationship. In an illustrated embodiment, the radius of the wall surface 45 may be between 1.27 mm and 33 mm (0.05 in. and 1.3 in.) with contact elements having a length, i.e. the length of the elements being the length of the cantilever beam of the active contact element from the position free of the curved surface to the contact portion, between 2.17 mm and 6.35 mm (0.0.85 in. and 0.25 in.). In the illustrated interconnector, the radius is between 3.2 mm (0.125 in.) and 8.9 mm (0.35 in.) and the length of the cantilever beam of the active contact element is between 2.17 mm (0.085 in.) and 2.9 mm (0.115 in.). The use of this contact support design for the active contact elements 15 allows the use of shorter contact elements, thinner material in the contact element, and narrower contact elements. This reduces the height and length of the interconnection, but maintains the desired contact force between the contact elements. Thus the stack height for the PCB's or the spacing between boards is reduced. This design with the curved support for the contact elements also reduces the insertion force, reduces the deleterious effect of vibration, and reduces stress relaxation as compared to a cantilever mounted spring loaded contact without the wall support. The shape of the contact elements 15 also improves surface contact, reduces cross talk by increasing spacing, and the small cross-section provides a better impedance match with plated circuitry on the PCB or flexible circuitry. The electrical length from the solder joint through the interconnection to the corresponding solder joint should be of equal length for all the interconnections between contact elements.

Figure 5:
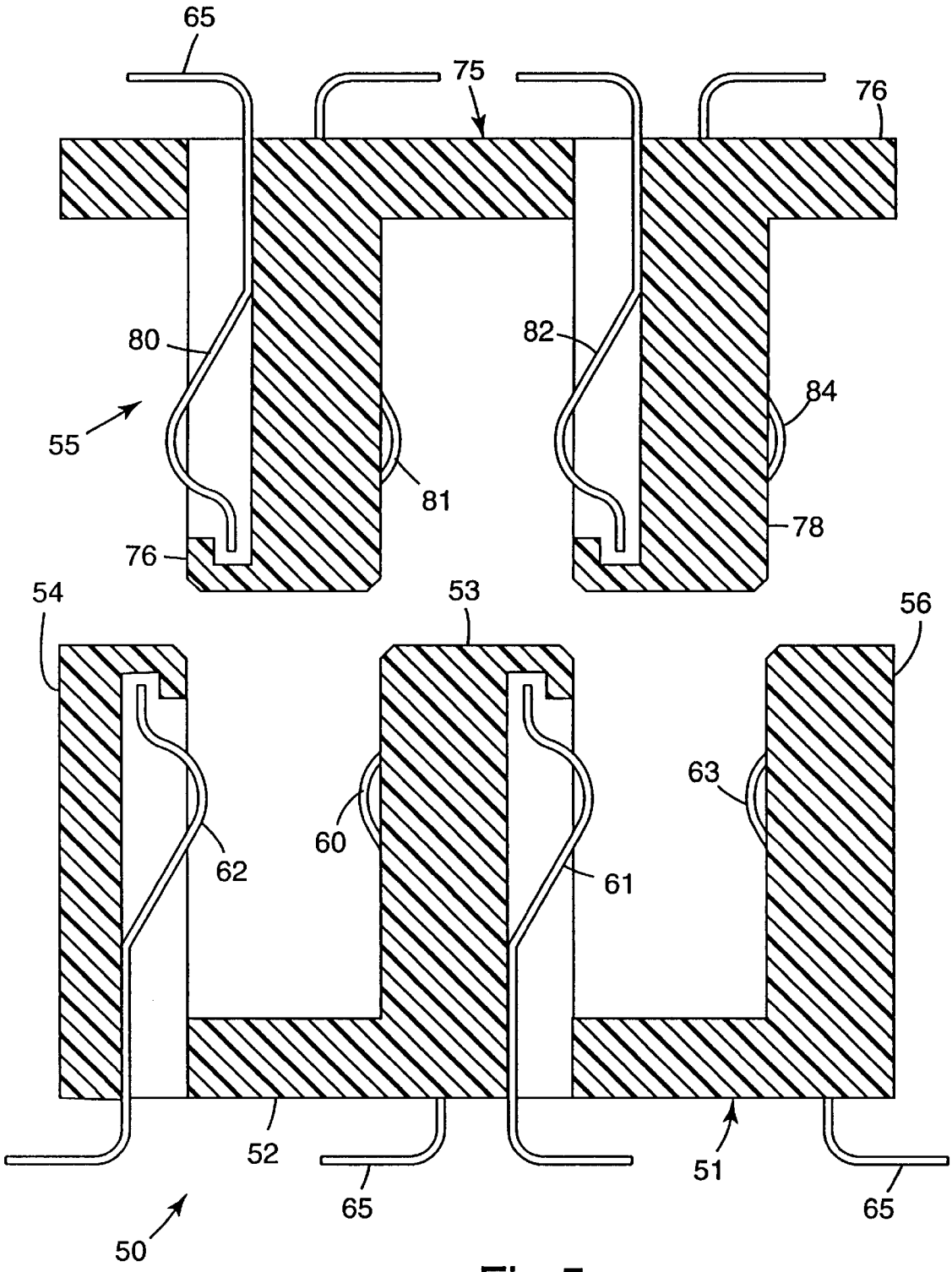
FIG. 5 is a vertical cross sectional view of a socket and plug of a first modification.

A further embodiment of an interconnection according to the present invention is illustrated in FIG. 5. In this embodiment, the socket 50 and the plug 55 each have a body as described above. The socket body 51 comprises a base 52 and three parallel wall members 53, 54 and 56 positioned on one side of the base 52 forming a central wall member 53 and opposed identical side wall members 54 and 56. The central wall member 53 has opposite surfaces and the side wall members have surfaces opposed to the opposite surfaces of the central wall member 53. Electrical contact elements 60 and 61 are positioned along the opposite surfaces of the central wall member 53 forming two rows of contact elements and electrical contact elements 62 and 63 are positioned along the opposed surfaces of the side wall members 54 and 56, respectively, forming two additional rows of contact elements. The contact elements 61 and 62 are aligned transversely of the socket 50 and they are staggered in relationship to the contact elements 60 and 63 along the rows formed by the solder tails 65 of the contact elements. This staggered pattern of the solder tails 65 in the four rows is shown in FIG. 6.

Figure 4:
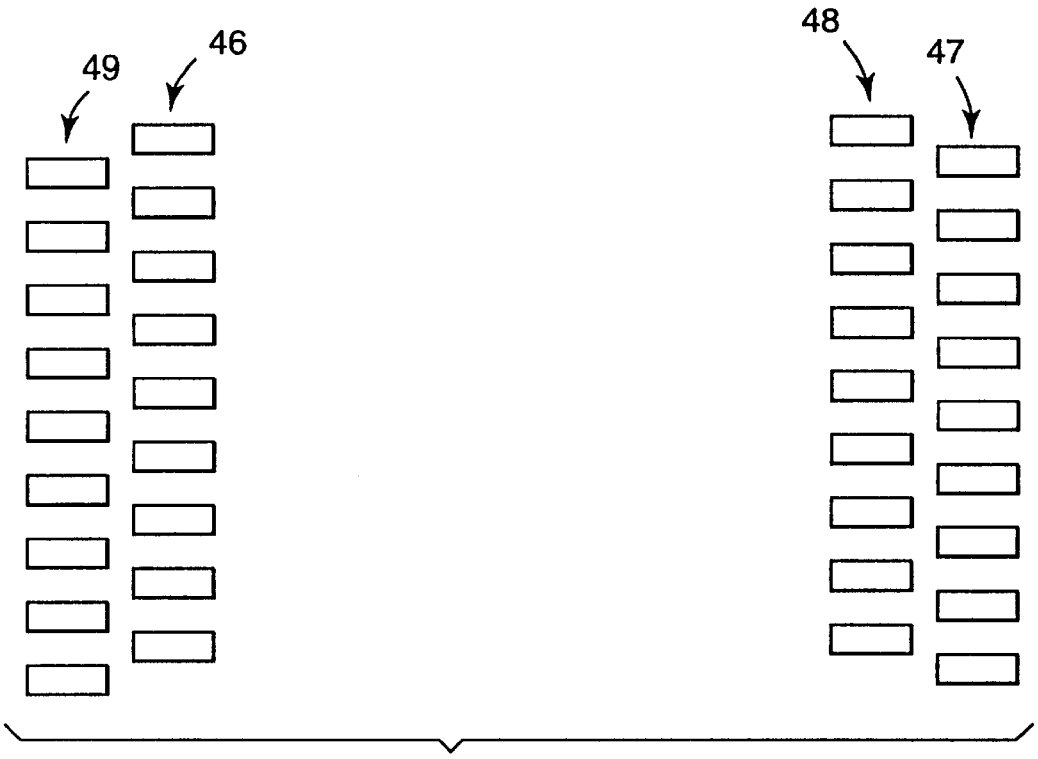
FIG. 4 is a schematic view showing the foot print of the socket or plug according to the embodiment of FIG. 3.

The plug 55 comprises a body 75 having a top wall 76 and at least two depending spaced parallel wall members 76 and 78, each wall member having opposite surfaces. The wall members 76 and 78 are adapted to be disposed one on each side of the central wall member 53 of the socket 50. Electrical contact elements 80 and 81 are positioned along the opposite surfaces of the parallel wall member 76 and electrical contact elements 82 and 84 are positioned along the opposite surfaces of the wall member 78. The contact elements 80 and 81 are offset longitudinally of the plug 55 and elements 80 and 82 are transversely aligned, thus forming four rows of contact elements in staggered relationship for electrical contact with the electrical contact elements 62, 60, 61 and 63 of the socket. The contacts 81 and 82, mate with the electrical contacts 60 and 61 positioned along the opposite surfaces of the central wall member 53 and the electrical contact elements 80 and 84 are positioned to make electrical contact with contact elements 62 and 63 along said side wall members 54 and 56. All the contact elements are illustrated as identical, however modifications may be made to the contacts to provide a foot print that has the solder feet in two single lines or in the staggered format as illustrated in FIG. 4 and as illustrated in the foot print of the socket in FIG. 6.

Figure 6:
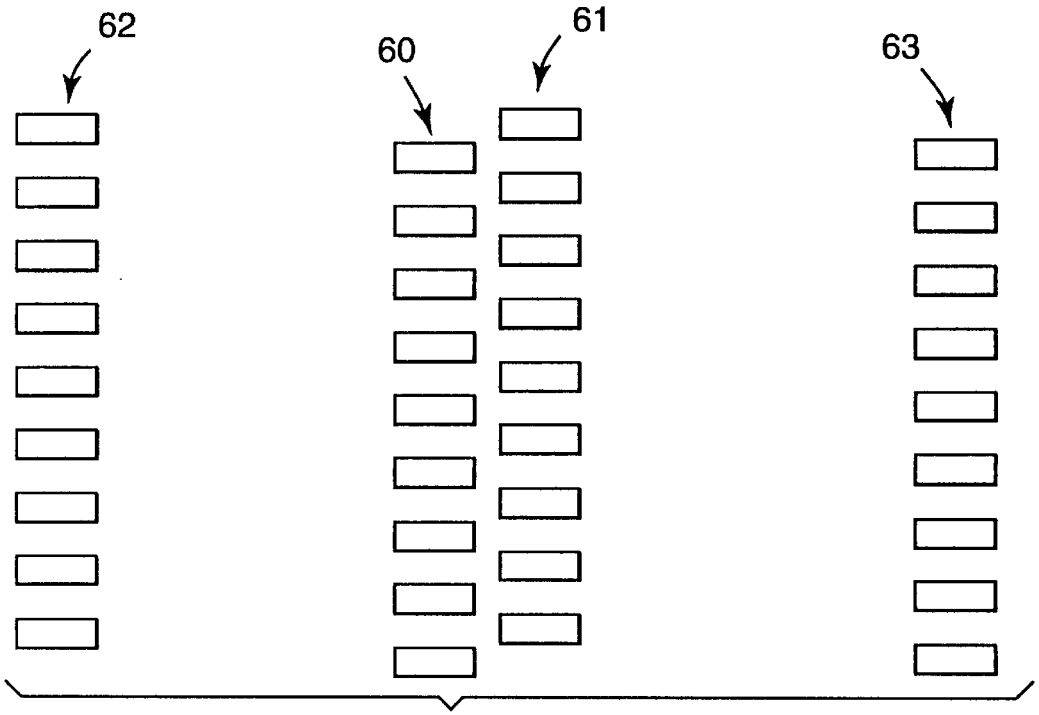
FIG. 6 is a schematic view of the foot print of the socket or plug according to FIG. 5.

FIG. 6 illustrates the foot print of the solder tails to the PCB from the socket 50. A first row of foot prints designates the respective position of the contacts for the contact elements 62, the second row illustrates the row of contact elements 60, the third row illustrates the row of contact elements 61, and the fourth row illustrates the row contact elements 63. The staggered form of these contact elements is staggered in a manner different from the pattern of the interconnection of FIG. 3. The patterns could be made similar on both devices without change to the invention.

Referring now to FIG. 7, a passive contact element 14 is illustrated, comprising a contact portion 80 of generally uniform dimension, and provided with a beveled free end to guide the mating contact element, a button 83 extending from the face provides a lock with the mating contact element, and projections 88 are formed on opposite edges near the base for making frictionally locking engagement with the walls of the opening 22 in the base or top wall to hold the contact element 14 in the base or top wall of the socket and plug. As referenced above the contact element 14 has a solder tail 14*a* of a reduced width and bent at an angle of about 85° to the contact portion 80. This included angle is less than 90° to place the solder tails in a plane. The solder tail 14*a* extends outward to an offset solder foot 14*b* which makes contact with the pad on a plated circuit.

FIG. 8 illustrates the active contact 15 and it is formed with an arcuate contact portion 85 formed adjacent the free end of the element where the width is the narrowest at about 0.45 mm (0.018 in.). The contact portion 85 is tapered from the body 86 having a width of 0.5 mm (0.02 in.). At the base of the body 86 are projections 88 for making frictional contact at opposite sides of openings 24 in the base 18 of the socket or in the top wall 31 of the plug to hold the element 15 in place. At the projections 88, the element 15 is 0.55 mm (0.022 in.) wide. The thickness of the material is 0.16 mm (0.0062 in.). The openings 24 are shaped to allow the contact portion 85 to pass into the body and then the wider body portion 86 enters a longer slotted portion of the opening (not shown) where the projections engage the ends of this slotted portion. The contact element 15 has a solder tail 15*a* formed at an angle to the body 86, with the included angle being at or near 85° to force the solder tail 15*a* against the outside surface of the base or top wall in the notches and to hold the body of the contact element 15 against the wall surfaces 45. The solder tails terminate at an offset solder foot 15*b* which makes electrical contact with the circuit pad. The reduced thickness and width of the contact element, together with the support wall 45, maintains the contact force, permits a flattening of the contact portion 85, provides good inductance, improved impedance, and reduces stress relaxation.

An alternative to the use of an angle of less than 90°, or about 85°, as the included angle between the contact element and the solder tails is to have the angle exceed 90°, for example 92°, such that when the retention devices 40 are fixed to the socket and to the board, the solder tails are spring loaded toward the circuit pads. This resilient mounting of the feet on the solder tails levels the solder tails at the time of assembly.

The material for the contact elements 14 and 15 is a brass alloy, No. C7025 from Olin Corporation of East Alton, Ill. The material is 96.2% copper, 3% nickel, 0.65% silicon and 0.15% magnesium.

Having described the present invention in connection with the illustrated embodiments, and a discussion of other alternative configurations, it will be appreciated that other changes in can be made without departing from the spirit or scope of the invention as described in the appended claims.

We claim:

1. A fine pitch electrical interconnection comprising:

a socket and a mating plug, said socket comprising a body including a base and three parallel wall members positioned on one side of the base forming a central wall member and opposed identical side wall members, said central wall member having opposite surfaces and said side wall members having surfaces opposed to the opposite surfaces of said central wall member, electrical contact elements positioned along the opposite surfaces of said central wall member forming two rows of contact elements and electrical contact elements positioned along the opposed surfaces of said side wall members, forming two additional rows of contact elements, the socket contact elements including both active contact elements and passive contact elements;

said plug comprising a body having a top wall and at least two depending spaced parallel wall members, each wall member having opposite surfaces, and said wall members being adapted to be disposed one on each side of said central wall member of said socket, electrical contact elements positioned along the opposite surfaces of said parallel wall members forming four rows of contact elements for electrical contact with said electrical contact elements positioned along the opposite surfaces of said central wall member and said electrical contact elements positioned along said side wall members, the plug contact elements including both active contact elements and passive contact elements;

wherein the active contact elements of the socket and plug engage arcuate wall surfaces upon the mating of the socket and the plug, which arcuate wall surfaces, backing the active contact elements, distribute the bending stress along the length of the active contact elements and movement of the active contact element toward said arcuate wall surface increases the force generated at the contact portion of the contact element.

2. A fine pitch electrical interconnection according to claim 1 wherein said electrical contact elements are resilient and supported in said base and top wall.

3. A fine pitch electrical interconnection according to claim 1 wherein said two rows of electrical contact elements positioned along the opposite surfaces of said central wall member of said socket are passive contact elements and said additional rows of contact elements on said side wall members are active contact elements, and said plug is formed with active contact elements on opposed walls of said parallel wall members to engage said passive contact elements on said central wall member and the contact elements on the opposite walls are passive contact elements.

4. A fine pitch electrical interconnection according to claim 3 wherein there are more passive contact elements on each side of the central wall member of said socket than active contact elements on the side walls of the socket.

5. A fine pitch electrical interconnection according to claim 1 wherein said contact elements on said socket and on said plug have solder tail portions extending from the side of the base and top wall to stepped feet positioned to be soldered to a board.

6. A fine pitch electrical interconnection according to claim 1 wherein said electrical contact elements on opposite sides of said central wall member are offset or staggered along the said two rows.

7. A fine pitch electrical interconnection according to claim 1 wherein said electrical contact elements on opposite sides of said central wall member are directly opposite and are staggered with relationship to said additional two rows of contact elements.

8. A fine pitch electrical interconnection according to claim 1 wherein there are four rows of solder tails corresponding with the contact elements of said socket and four rows of solder tails corresponding with the contact elements of said plug with the solder tails from the contact elements supported from said central wall member being disposed inward and in adjacent staggered relationship to said solder tails from the contact elements supported by the side wall members.

9. A fine pitch electrical interconnection according to claim 1 wherein the socket and plug form mirror images about a plane forming a longitudinal section thereof.

10. A fine pitch electrical interconnection comprising:

a socket having a body including a base and three parallel wall members positioned on one side of the base forming a central wall member and opposed side wall members, identical active contact members supported on said side wall members and identical passive contact members supported on opposite sides of said central wall member, a plug adapted to mate with said socket, said plug comprising a body having a top wall and at least two depending spaced parallel wall members spaced to receive said central wall member of said socket, said wall members of said plug having means supporting spaced active contact members affording engagement with said passive contact members on said central wall member and said wall members of the plug having outside wall surfaces supporting passive contact members affording electrical engagement with said active contact members on said socket side wall members;

wherein the active contact elements of the socket and plug engage arcuate wall surfaces upon the mating of the socket and the plug, which arcuate wall surfaces, backing the active contact elements, distribute the bending stress along the length of the active contact elements and movement of the active contact element toward said arcuate wall surface increases the force generated at the contact portion of the contact element.

11. A fine pitch electrical interconnection according to claim 10 wherein there are more passive contact elements on each side of the central wall member of said socket than active contact elements on the side walls of the socket.

12. A fine pitch electrical interconnection according to claim 10 wherein said contact elements have solder tail portions, and the solder tail portions of said contact elements of said central wall member of the socket form two rows of contact bonds positioned within the two rows of contact bonds formed by the solder tails of said active contact elements positioned on opposed sides of said side wall members.

13. A fine pitch electrical interconnection according to claim 10 wherein the socket and plug form mirror images about a plane forming a longitudinal section thereof.

14. A fine pitch electrical interconnection according to claim 12 wherein the socket and plug form mirror images about a plane forming a longitudinal section thereof.

15. A fine pitch electrical interconnection according to claim 14 wherein the active contact elements of said socket and plug are mounted to resiliently engage the passive contact elements, and each are formed with a arcuate end portion forming the contact portion which interfers with and contacts the passive contact elements upon mating the socket with the plug.

16. A fine pitch electrical interconnection comprising:

a mating socket and plug, said socket comprising a body including a base and three parallel wall members positioned on one side of the base forming a central wall member and opposed identical side wall members, said central wall member having opposite surfaces and said side wall members having surfaces opposed to the opposite surfaces of said central wall member, two rows of identical active contact elements are supported on said side wall members and two rows of identical passive contact elements are supported on said central wall member in staggered relationship, said contact elements each having solder tail portions extending through said base for equal distances to a stepped foot adapted to bond to a circuit, said plug comprising a top wall and at least two depending spaced parallel wall members adapted to be disposed one on each side of said central wall member of said socket, said wall members of said plug having means supporting two rows of spaced active contact elements affording engagement with said two rows of passive contact elements on said socket, and said wall members of said plug having outside wall surfaces supporting contact elements affording electrical engagement with said contact elements on the socket side wall members, and said contact elements on said plug having solder tail portions extending an equal distance through said top wall portion to a stepped foot adapted to bond to a circuit;

wherein said socket side wall members and said plug opposed walls of said parallel wall members all have surfaces backing up the active contact elements, and said surfaces are formed with an arcuate face curving outwardly from the base and top wall, whereby the force generated in the active contact element toward the free end spaced from the base and top wall increases as the active contact elements are flexed to engage the arcuate surfaces, affording active contact elements of reduced thickness and width to improve impedance, inductance and reduce the deleterious affects of vibration.

* * * * *